US006085541A

United States Patent [19]

Harukawa

[11] Patent Number: 6,085,541

[45] Date of Patent: Jul. 11, 2000

[54] COLD WATER SUPPLY APPARATUS

[75] Inventor: Tsuneo Harukawa, Shizuoka, Japan

[73] Assignee: K E Corporation Co., Ltd., Shizuoka, Japan

[21] Appl. No.: 09/171,246

[22] PCT Filed: Nov. 28, 1997

[86] PCT No.: PCT/JP97/04349

§ 371 Date: Dec. 28, 1998

§ 102(e) Date: Dec. 28, 1998

[87] PCT Pub. No.: WO98/36231

PCT Pub. Date: Aug. 20, 1998

[51] Int. Cl.[7] ..... F25D 11/00

[52] U.S. Cl. ..... 62/430; 62/434

[58] Field of Search ..... 62/430, 436, 434, 62/238.6

[56] References Cited

U.S. PATENT DOCUMENTS

| | | | |
|---|---|---|---|
| 2,292,692 | 8/1942 | Huber | 62/434 |
| 4,370,864 | 2/1983 | Wessa | 62/98 |
| 4,757,690 | 7/1988 | Holowczenko et al. | 62/59 |
| 5,535,600 | 7/1996 | Mills | 62/390 |
| 5,553,463 | 9/1996 | Pointer | 62/238.6 |
| 5,944,089 | 8/1999 | Roland | 165/10 |

FOREIGN PATENT DOCUMENTS

| | | | |
|---|---|---|---|
| 63-17995 | 8/1989 | Japan | 62/430 |

*Primary Examiner*—Henry Bennett
*Assistant Examiner*—Melvin Jones
*Attorney, Agent, or Firm*—Price, Gess & Ubell

[57] ABSTRACT

A multiplicity of water passage pipes (4) are received in a horizontal, cylindrical-shaped drum (3), which is provided at an upper portion thereof with a discharge port (3*a*) and an inflow port (3*b*) for a refrigerant. Fixed to both ends of the drum (3) are a water introduction cylinder (6) and a discharge cylinder (7), which is bent downward to be substantially L-shaped. A heat exchanger (1) is secured such that en end thereof on a side of the discharge cylinder (7) is disposed above a cold water tank (2). An interior of the cold water tank (2) is divided into a first tank (2*a*) and a second tank (2*b*) by a partition (8), over which water can flow. A piping for supplying a cold water to a facility for utilization of the cold water is connected to a bottom or a lower portion of the first tank (2*a*), on which the cold water from the heat exchanger (1) falls. A path for water recovery from the facility for utilization of the cold water is connected to the second tank (2*b*) through a return piping (11). The second tank (2*b*) is connected to a side of the water introduction cylinder (6) of the heat exchanger (1) through a cold water circulating pump (12). When water circulation for the heat exchanger (1) is stopped, water in the heat exchanger (1) is discharged to fall in the cold water tank (2), thereby preventing freezing.

8 Claims, 4 Drawing Sheets

COLD WATER SUPPLY APPARATUS

TECHNICAL FIELD

The present invention relates to a cooling water supply apparatus for obtaining cooling water by performing heat exchange between water and a coolant circulating inside a heat exchanger.

BACKGROUND ART

Various types of cooling apparatuses that employ a coolant in the prior art include cooling water supply apparatuses for supplying cooling water to factories, stores and the like. In such a cooling water supply apparatus, water and the coolant are caused to circulate inside a heat exchanger so that by performing heat exchange between the coolant and the water, cooling water can be obtained.

A heat exchanger employed in such a cooling water supply apparatus normally adopts a structure in which piping is provided inside a drum. Since a chiller unit for cooling the coolant is connected to the drum, the coolant can circulate inside the drum. In addition, the piping is provided in such a manner that water can flow inside and the discharge side of the piping is connected to a path through which cooling water is supplied to a utilizing facility, such as a factory, a store or the like.

Cooling water is created at the cooling water supply apparatus described above in the manner described below. Namely, coolant from the chiller unit is supplied into the drum of the heat exchanger and at the same time, water is supplied into the piping. This places the coolant and the water in contact with each other via the piping, and, as a result, the heat in the water in the piping is drawn out by the coolant around the piping so that the water becomes cold. This cold water is delivered into the supply path and is eventually utilized as cooling water at the utilizing facility.

However, the cooling water supply apparatus described above still poses the problem described below that is yet to be addressed. Namely, since the circulation of water inside the heat exchanger is stopped during, for instance, night time when it is not necessary to supply cooling water to the utilizing facility, which leaves residual water inside the piping, the coolant and the still water remain in contact over a long period of time via the piping. Consequently, the water inside the piping may become frozen, disabling circulation of water when the operation restarts or damaging the piping.

An object of the present invention which has been proposed to eliminate the problem of the prior art discussed above, is to provide a cooling water supply apparatus with which water can be prevented from becoming frozen inside the heat exchanger after water circulation is stopped.

DISCLOSURE OF INVENTION

In the cooling water supply apparatus according to the present invention which is provided with a heat exchanger in which a coolant and water can circulate and a cooling water tank for storing cooling water obtained by performing heat exchange between the coolant and the circulating water inside the heat exchanger, the heat exchanger is positioned above the cooling water tank so that when the water circulation inside the heat exchanger is stopped, the water inside the heat exchanger drains into the cooling water tank.

According to the present invention, since the water inside the heat exchanger drains into the cooling water tank when cooling water supply is not required and the water circulation is stopped, the coolant and the water are no longer in contact, thereby preventing the water from freezing. In particular, by forming a water discharge portion and a water intake portion at the heat exchanger in a downward direction, water discharge is effected by gravity, thereby eliminating the necessity for providing a special motive force for water discharge.

In addition, the inside of the cooling water tank may be divided into a first tank and a second tank with a partition, with the partition formed at a height which allows cooling water to overflow from the first tank to the second tank. Furthermore, the discharge portion through which the cooling water is discharged from the heat exchanger may be provided above the first tank with the second tank connected to the intake portion of the heat exchanger.

This structure allows cooling water that is at a relatively high temperature in the upper portion of the first tank to overflow over the partition into the second tank and to be taken into the heat exchanger through the intake portion to be cooled again and flow down into the first tank through the discharge portion so that cooling water can be obtained with a high degree of efficiency. In particular, by connecting a supply path for supplying the cooling water to the utilizing facility to the first tank and connecting a return path through which the cooling water that has been utilized at the utilizing facility returns to the second tank, the water whose temperature has increased through the utilization at the utilizing facility after it is supplied to the utilizing facility through the supply path from the first tank is collected into the second tank via the return path. Consequently, the water at high temperature that is collected does not directly mix with the water in the first tank, which allows the water in the first tank to maintain a low temperature at all times to achieve a supply of cooling water whose quality is stable.

Moreover, a coolant tank where the coolant is temporarily stored after a heat exchange may be provided below the heat exchanger. Since this structure allows the coolant inside the heat exchanger to be discharged and flow down into the coolant tank after the coolant circulation is stopped, the coolant and the water do not come into contact with each other, thereby preventing freezing.

BEST MODE FOR CARRYING OUT THE INVENTION

The following is an explanation of a specific embodiment of the present invention in reference to the drawings.

(1 Structure)

Figure 1:
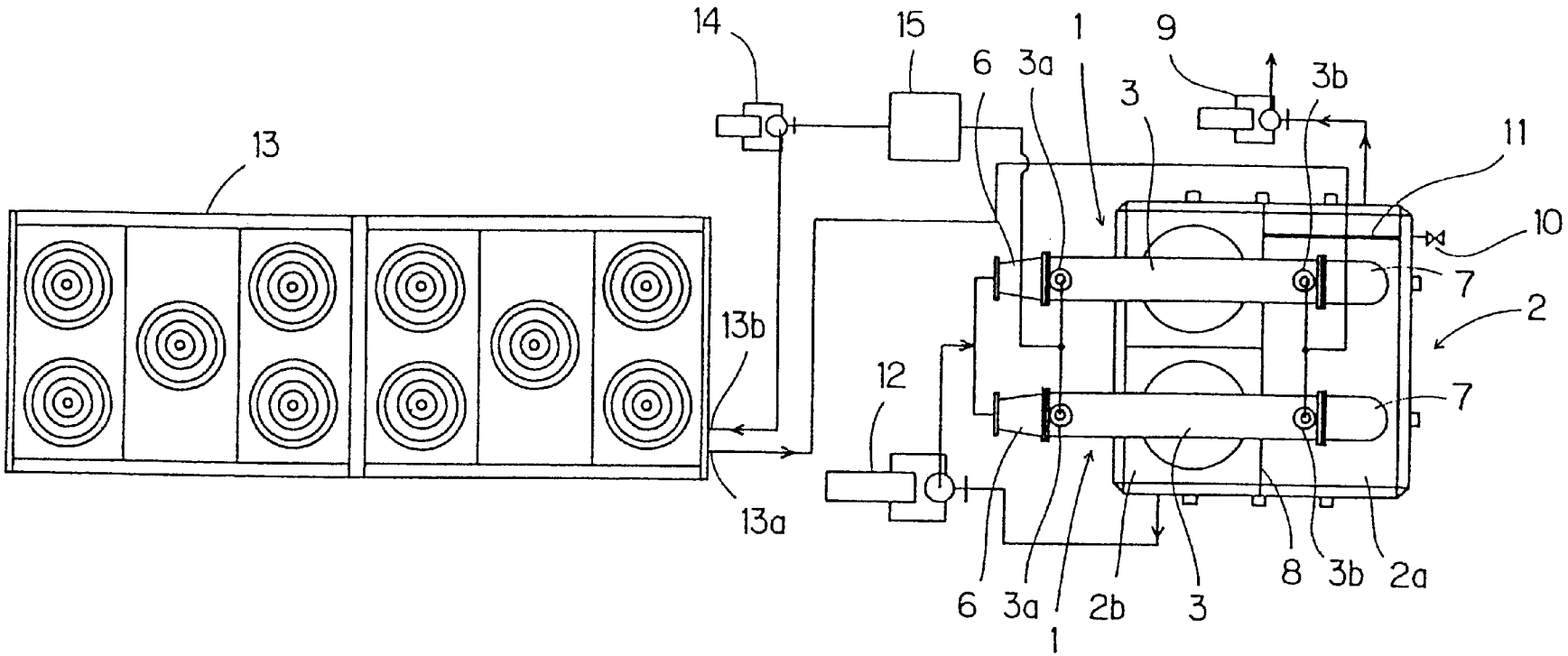
FIG. 1 is a plan view illustrating an embodiment of the cooling water supply apparatus according to the present invention.

This embodiment comprises a pair of heat exchangers 1 that provide cooling water by circulating water inside and a cooling water tank 2 that stores the cooling water from the heat exchangers 1, as illustrated in FIG. 1. The structure of the heat exchangers 1 and the cooling water tank 2 are explained separately below.

(1—1) Structure of the heat exchanger

Figure 2:
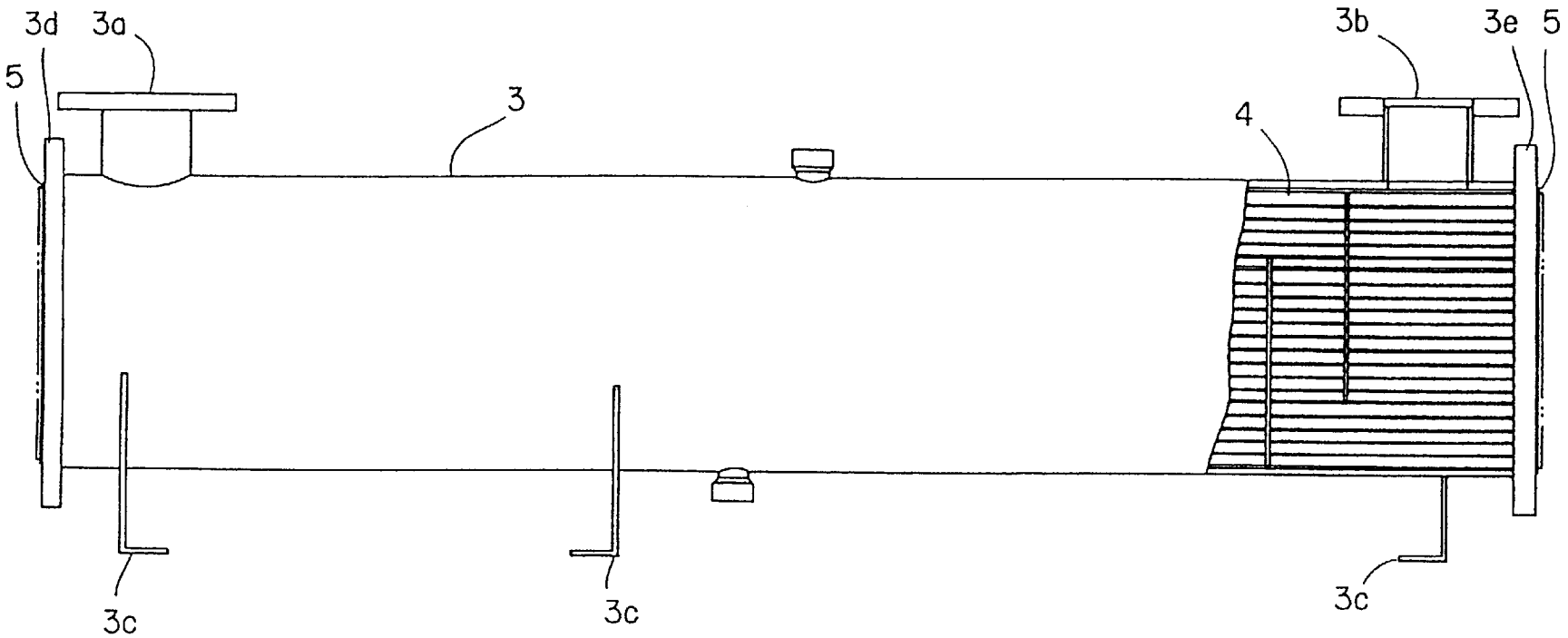
FIG. 2 is a partial cutaway side view of the drum in the embodiment illustrated in FIG. 1.
Figure 3:
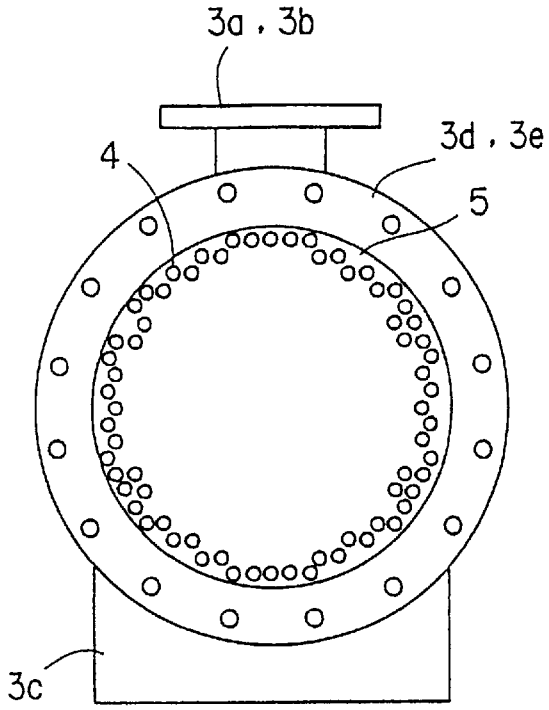
FIG. 3 is a front view of FIG. 2.

As shown in FIGS. 2 and 3, a plurality of water flow pipes 4 are housed inside a drum 3 which is formed in a lateral cylindrical shape in a direction parallel to the axis of the drum 3. The two ends of the cylindrical drum 3 are sealed off by lid plates 5. At the upper portion of the drum 3, a discharge port 3*a* and an inflow port 3*b* for a coolant (hereafter referred to as brine) are provided. Leg portions 3*c* are provided at the lower portion of the drum 3.

Figure 4:
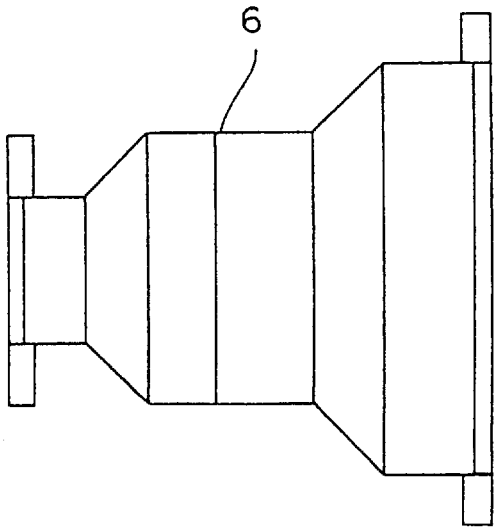
FIG. 4 is a side elevation illustrating the intake cylinder in the embodiment illustrated in FIG. 1.
Figure 5:
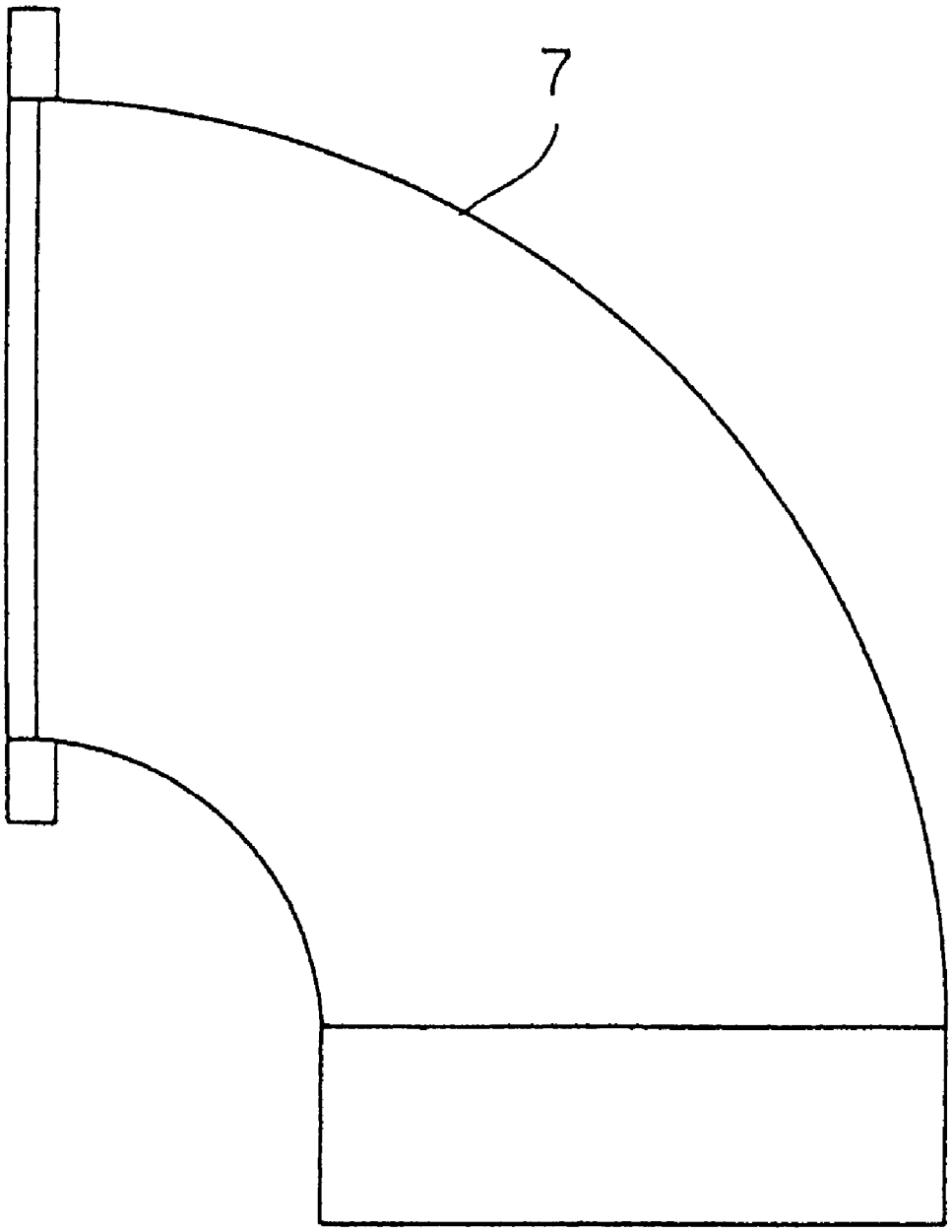
FIG. 5 is a side elevation illustrating the discharge cylinder in the embodiment illustrated in FIG. 1.

In addition, the two ends of each water flow pipe 4 project out to the outside of the two ends of the drum 3 through the lid plates 5. At the two ends of the drum 3, flanges 3*d* and 3*e* are provided. A water introduction cylinder 6 and a water discharge cylinder 7, as illustrated in FIGS. 4 and 5, are secured to the flanges 3*d* and 3*e* respectively. The ends of the water flow pipes 4 are exposed in the space inside the introduction cylinder 6 and the discharge cylinder 7 so that a structure in which water supplied through the introduction cylinder 6 travels through the water flow pipes 4 to be delivered into the space inside the discharge cylinder 7 located on the opposite side of the drum 3 is achieved. It is to be noted that, as illustrated in FIG. 5, the discharge cylinder 7 is formed in a shape which bends downward in a rough L shape.

Furthermore, as shown in FIG. 1, which illustrates the overall structure of the apparatus, two heat exchangers 1 are provided parallel to each other. The leg portions 3*c* of the drums 3 are secured to the upper portion of the cooling water tank 2 so that the ends of the two heat exchangers 1 toward the discharge cylinders 7 will be located above the cooling water tank 2.

Moreover, a chiller unit 13 for supplying cooled brine is connected to the heat exchangers 1 structured as described above. Namely, the inflow port 3*b* and the discharge port 3*a* at the upper portion of each drum 3 are respectively connected to an outflow port 13*a* and an inflow port 13*b* of the chiller unit 13 via piping. In addition, a brine pump 14 and an expansion tank 15 are provided at the piping located toward the inflow port 13*b*.

(1—2 Structure of the cooling water tank)

At the center of the space inside the cooling water tank 2, a partition 8 is provided to divide the space into a first tank 2*a* (the right side in FIG. 1) and a second tank 2*b* (the left side in FIG. 1) to achieve a two-tank structure. The upper portion of the partition 8 is set lower than the upper portion of the cooling water tank 2 so that cooling water can overflow from the first tank 2*a* into the second tank 2*b*.

The first tank 2*a* is employed as a water supply tank for supplying cooling water flowing down from the heat exchangers 1 to the utilizing facility. Namely, piping for supplying cooling water that has been cooled at the heat exchangers 1 is connected to the bottom or the lower portion of the first tank 2*a*. This piping is extended to the utilizing facility such as a factory, a store or the like where the cooling water is used via a cooling water supply pump 9.

The second tank 2*b*, on the other hand, is a collecting tank for collecting water whose temperature has risen after being used at the utilizing facility. Namely, as illustrated in FIG. 1, a water feed port 10 is provided at the first tank 2*a* of the cooling water tank 2. A water collection path for collecting water that has been used at the utilizing facility is connected to the water feed port 10. However, it is to be noted that the water feed port 10 is not in communication with the first tank 2*a*, but is connected to the second tank 2*b* constituting the collecting tank through a return piping 11 indicated with the bold line in FIG. 1.

Moreover, piping connected to the introduction cylinders 6 of the heat exchangers 1 is connected to the second tank 2*b* via a cooling water circulating pump 12. Thus, a structure in which the water collected in the second tank 2*b* is sent out to the heat exchangers 1 by the cooling water circulating pump 12 and is cooled again by coming into contact with the brine circulating the outer perimeter of the water flow pipes 4 while it travels through the water flow pipes 4 of the heat exchangers 1 is achieved.

(2 Functions)

The functions of the embodiment structured as described above are as follows. First, the brine that has been cooled at the chiller unit 13 is supplied via the inflow ports 3*b* at the upper portions of the drums 3. It is assumed that the temperature of the brine to be supplied is set at, for instance, −7° C. The brine thus supplied draws out the heat from the water within the water flow pipes 4, resulting in its temperature increasing to, for instance, approximately −3° C. before it is discharged through the discharge ports 3*a*. The brine thus discharged is returned to the chiller unit 13 by the brine pump 14, cooled in the unit and is supplied again to the inflow ports 3*b* of the drums 3.

The water inside the second tank 2*b*, on the other hand, is supplied to the water flow pipes 4 inside the heat exchangers 1 through the introduction cylinders 6 by the cooling water circulating pump 12. The heat in the water thus supplied is drawn out by the brine during the process in which the water travels through the water flow pipes 4, as explained earlier, resulting in its temperature cooling down to, for instance, approximately 1° C., before it is sent out toward the discharge cylinders 7 on the opposite side of the drums 3. The discharge cylinders 7 of the heat exchangers 1 are located above of the first tank 2*a* of the cooling water tank 2, with the discharge cylinders 7 bending downward, which allows the cooled water to flow down through the discharge cylinders 7 into the first tank 2*a*.

Thus, in the first tank 2*a*, where the cooling water that has flowed down is collected, the cooling water whose temperature is relatively high is collected in its upper portion and the cooling water whose temperature is relatively low concentrates in the bottom portion, due to convection currents in the water. Then, the cooling water at low temperature toward the bottom of the first tank 2*a* is sent out by the cooling water supply pump 9 through the piping connected to the bottom or the lower portion of the first tank 2*a* to be supplied to the utilizing facility, such as a factory, a store or the like.

In addition, the cooling water at a relatively high temperature in the upper portion of the first tank 2*a*, which overflows over the partition 8 into the second tank 2*b*, is delivered into the introduction cylinders 6 by the cooling water circulating pump 12 again to be further cooled at the heat exchangers 1.

Then, water whose temperature has increased to, for instance, approximately 16° C. after being used at the utilizing facility, is collected into the second tank 2*b* via the water feed port 10 through the return piping 11, is delivered into the heat exchangers 1 by the cooling water circulating pump 12 to be cooled again.

In order to halt the cooling water supply process described above, the cooling water supply pump 9, the cooling water circulating pump 12 and the brine pump 14 are stopped. This will cut off water supply to the drums 3 and, at the same time, the water inside the discharge cylinders 7 bending downward and the water inside the water flow pipes 4 communicating with the discharge cylinders 7 flow down into the first tank 2*a* of the cooling water tank 2 by gravity, thereby emptying the water passage pipes 4.

(3 Advantages)

The following advantages are achieved through the embodiment of the present invention. Namely, since the water passage pipes 4 are emptied when the apparatus is stopped, the brine and the water do not remain in contact, thereby eliminating the risk of defective circulation due to freezing and of damage to the piping.

In particular, since water flows down from the heat exchangers 1 into the cooling water tank 2 by gravity, water can be automatically discharged without having to employ a special motive force so that a trouble-free water discharge process is realized while only requiring a low production cost for manufacturing the apparatus.

In addition, since cooling water at relatively low temperature inside the first tank 2*a* is supplied to the utilizing facility and cooling water at a relatively high temperature inside the first tank 2*a* is allowed to overflow into the second tank 2*b* to be guided into the heat exchangers 1 again, cooling water can be obtained with a high degree of efficiency and cooling water at a stable low temperature can be supplied to the utilizing facility at all times.

Furthermore, since water at high temperature that has been used at the utilizing facility and has been collected through the water feed port 10 is supplied to the second tank 2*b,* it does not mix directly with the cooling water inside the first tank 2*a.* Consequently, only water that has been fully cooled is supplied to the utilizing facility without reducing the cooling effect achieved by the heat exchangers 1.

Moreover, since cooling water is supplied via the cooling water tank 2 rather than constituting a cooling water circulating path only with piping, it is easier to support fluctuations in the demand for cooling water. Particularly, even when a large quantity of cooling water exceeding the cooling capability of the heat exchangers 1 is required, the demand for such a large quantity of cooling water can be satisfied by sending out low-temperature water that has been stored in the first tank 2*a* in advance.

(4) Other embodiments

The present invention is not limited to the example explained in reference to the embodiment presented above, and a number of variations may be conceived in regard to the shape, quantity, position, size and the like of the individual members. For instance, the quantity and the size of the heat exchangers 1, the water passage pipes 4 and the cooling water tank 2 and the forming positions and the like of the brine discharge ports 3*a,* the brine inflow ports 3*b* and the water feed port 10 may be freely changed during the design stage.

In addition, both the introduction cylinders 6 and the discharge cylinders 7 described in reference to the embodiment above may be formed in a shape bending downward in an L shape so that when the water circulation is stopped, the water inside the water passage pipes 4 flows down toward both the introduction cylinders 6 and the discharge cylinders 7 (toward the two ends of the drums 3) due to gravity. This structure will allow the water inside the heat exchangers 1 to be discharged even faster with an even higher degree of reliability. It is to be noted that when this structure is adopted, the position of the cooling water tank 2 located under the heat exchangers 1 may be adjusted to receive water flowing down from the two ends of the drums 3.

Alternatively, only the introduction cylinders 6 may be positioned downward, or the drums 3 may be provided inclined toward either the introduction cylinders 6 or the discharge cylinders 7 to achieve faster discharge of water effected by the inclination.

Furthermore, a structure in which the discharge port 3*a* for the brine at each drum 3 in the embodiment described above may be formed facing downward, with the coolant tank connected to the discharge port 3*a* so that the brine discharges from the drums 3 is first stored at the coolant tank before it is returned to the chiller unit 13, may be adopted. This structure, in which the coolant inside the drums 3 flows down by gravity to be discharged and stored at the coolant tank when the circulation of the coolant is stopped, ensures that the coolant and the water do not come into contact with each other subsequently to prevent freezing.

Moreover, the heat exchangers may be structured so that the flow paths of the cooling water and the coolant are swapped. For instance, the coolant may be caused to flow inside pipes provided inside the drums, with cooling water made to travel within the drums outside the pipes. In this case, too, it is necessary to ensure that the heat exchangers are emptied of cooling water with the cooling water flowing down into the tank by gravity when the circulation of the cooling water is stopped by, for instance, adopting a structure in which the water discharge ports of the drums are provided facing toward the tank. In addition, a structure that ensures that the coolant flows down into the cooling water tank by gravity to empty the heat exchangers of the coolant when the circulation of coolant is stopped, as described earlier, may be adopted.

Industrial Applicability

As has been explained, according to the present invention, a cooling water supply apparatus with which it is possible to prevent freezing inside the heat exchangers after stopping the water circulation is provided.

What is claimed is:

1. A cooling water supply apparatus comprising:

a heat exchanger in which a coolant and water can circulate; and a cooling water tank for storing cooling water obtained by performing heat exchange between said coolant and circulating water inside said heat exchanger, wherein;

said heat exchanger is provided above said cooling water tank so that when circulation of said water for said heat exchanger is stopped, said water inside said heat exchanger is discharged to flow down into said cooling water tank;

a water discharge portion and a water intake portion are provided at said heat exchanger;

a partition is provided at said cooling water tank to divide the space inside said cooling water tank into a first tank and a second tank;

said partition is formed at a height which allows cooling water to overflow from said first tank and to said second tank;

said discharge portion is provided at an upper portion of said first tank so that cooling water from said heat exchanger can flow down into said first tank; and said second tank is connected to said intake portion to allow water discharged from said second tank to flow into said heat exchanger.

2. A cooling water supply apparatus according to claim 1, wherein:

a supply path through which cooling water is supplied to a utilizing facility is connected to said first tank; and a return path through which cooling water that has been utilized at said utilizing facility is returned is connected to said second tank.

3. A cooling water supply apparatus according to claim 2, wherein:

said discharge portion is formed in a direction toward said cooling water tank provided below.

4. A cooling water supply apparatus according to claim 2, wherein:

said intake portion is formed in a downward direction.

5. A cooling water supply apparatus according to claim 1, wherein:

said discharge portion is formed in a direction toward said cooling water tank provided below.

6. A cooling water supply apparatus according to claim 5, wherein:

said intake portion is formed in a downward direction.

7. A cooling water supply apparatus according to claim 1, wherein:

said intake portion is formed in a downward direction.

8. A cooling water supply apparatus provided with a heat exchanger in which a coolant and water can circulate to obtain cooling water by performing heat exchange between said coolant and circulating water inside said heat exchanger, wherein:

a coolant tank for temporarily storing coolant for which heat exchange with said circulating water has been performed inside said heat exchanger is provided; and said heat exchanger is provided above said coolant tank so that when circulation of said coolant for said heat exchanger is stopped, said coolant inside said heat exchanger is discharged to flow down into said coolant tank.

* * * * *